US009691254B2

(12) United States Patent
Jeong

(10) Patent No.: US 9,691,254 B2
(45) Date of Patent: Jun. 27, 2017

(54) REAL-TIME ALARM SYSTEM FOR FIELD SAFETY MANAGEMENT AND DRIVING METHOD THEREOF

(71) Applicant: Yong-Ho Jeong, Seoul (KR)

(72) Inventor: Yong-Ho Jeong, Seoul (KR)

( * ) Notice: Subject to any disclaimer, the term of this patent is extended or adjusted under 35 U.S.C. 154(b) by 0 days.

(21) Appl. No.: 14/909,556

(22) PCT Filed: Mar. 27, 2015

(86) PCT No.: PCT/KR2015/003042
§ 371 (c)(1),
(2) Date: Feb. 2, 2016

(87) PCT Pub. No.: WO2016/093435
PCT Pub. Date: Jun. 16, 2016

(65) Prior Publication Data

US 2016/0343228 A1 Nov. 24, 2016

(30) Foreign Application Priority Data

Dec. 10, 2014 (KR) ..... 10-2014-0176944
Dec. 19, 2014 (KR) ..... 10-2014-0184350

(51) Int. Cl.
*G08B 1/08* (2006.01)
*G08B 21/04* (2006.01)
(Continued)

(52) U.S. Cl.
CPC ..... *G08B 21/0453* (2013.01); *G08B 21/02* (2013.01); *G08B 21/043* (2013.01);
(Continued)

(58) Field of Classification Search
CPC .. G08B 21/0453; G08B 25/10; A61B 5/0022; A61B 5/021; A60B 5/02444
(Continued)

(56) References Cited

U.S. PATENT DOCUMENTS

2004/0027246 A1* 2/2004 Aguglia ..... A61B 5/0002 340/573.1
2010/0081411 A1* 4/2010 Montenero ..... G08B 21/0233 455/404.2

(Continued)

*Primary Examiner* — Toan N Pham
(74) *Attorney, Agent, or Firm* — Paratus Law Group, PLLC

(57) ABSTRACT

A real-time alarm system for field safety management, including: an RF communication module for outputting a warning sound or making an LED emit light, as a warning signal is received through an RF transmit and receive unit; a field management communication terminal for monitoring in real-time a body temperature displacement value, a heartbeat displacement value or a slope displacement value transmitted from the RF communication module and creating the warning signal; and a general server for periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located.

15 Claims, 5 Drawing Sheets

(51) Int. Cl.
*G08B 21/02* (2006.01)
*G08B 25/10* (2006.01)
*G08B 7/06* (2006.01)

(52) U.S. Cl.
CPC ..... *G08B 21/0446* (2013.01); *G08B 25/10* (2013.01); *G08B 7/06* (2013.01)

(58) Field of Classification Search
USPC ..... 340/539.12, 573.1, 3.1, 5.1, 6.1, 7.58, 340/7.59, 7.6, 7.61, 7.62; 455/404.2; 600/300, 364
See application file for complete search history.

(56) References Cited

U.S. PATENT DOCUMENTS

2010/0298683 A1* 11/2010 Cabrera ..... A61B 5/0002 600/364
2012/0203076 A1* 8/2012 Fatta ..... A61B 5/681 600/300
2016/0029890 A1* 2/2016 Stump ..... A61B 5/0022 600/301

* cited by examiner

REAL-TIME ALARM SYSTEM FOR FIELD SAFETY MANAGEMENT AND DRIVING METHOD THEREOF

CROSS REFERENCE TO PRIOR APPLICATION

This application is a National Stage Patent Application of PCT International Patent Application No. PCT/KR2015/003042 (filed on Mar. 27, 2015) under 35 U.S.C. §371, which claims priority to Korean Patent Application Nos. 10-2014-0176944 (filed on Dec. 10, 2014) and 10-2014-0184350 (filed on Dec. 19, 2014), which are all hereby incorporated by reference in their entirety.

BACKGROUND OF THE INVENTION

Field of the Invention

The present invention relates to a communication control technique, particularly, to a real-time alarm system for field safety management and a driving method thereof, which monitors in real-time a body temperature displacement value, a heartbeat displacement value or a slope displacement value transmitted from an RF communication module existing inside or outside a workplace and creates a warning signal to make a warning sound or to make an LED emit light if the body temperature displacement value, the heartbeat displacement value or the slope displacement value is larger than a reference body temperature displacement value, a reference heartbeat displacement value or a reference slope displacement value.

Background of the Related Art

Generally, since a plurality of workers is dispatched in various fields and performs work in a construction site and safety accidents also occur quite frequently, safety management for the workers is very important. However, since only a very small number of managers are operated to manage a lot of workers, there is a limit for a manager to correctly grasp all the working situations occurring in the construction site and prevent the safety accidents in advance.

Particularly, since the rate of generating a safety accident or a risk thereof is increased furthermore in a large construction site where a lot of heavy equipment or the like is used, a system capable of efficiently managing safety is needed furthermore.

A conventional safety management apparatus which expresses a dangerous situation through an alarm, a warning light, SMS or the like when a risk factor is occurred by a structure installed in a construction site has a problem in that a worker working inside the equipment cannot hear the alarm and workers outside the equipment cannot hear the alarm sound since the noise in the construction site is too loud.

In addition, the conventional safety management apparatus has a problem in that workers in the construction site cannot pay attention to the warning light since they are doing a work needed in the construction site.

In addition, the conventional safety management apparatus is confronted with a realistic barrier in that there are a lot of difficulties in coping with an unexpected accident caused by operational problems of the current system which takes several tens of minutes in maximum to deliver safety state information to the workers in the construction site.

In addition, the conventional safety management system has an unreasonable point of requiring a lot of manpower and equipment and consuming excessive cost in constructing a system for preventing a safety accident.

SUMMARY OF THE INVENTION

Therefore, a method of driving a real-time alarm system for field safety management of the present invention has been made to solve the problems of the conventional technology, and a first object of the present invention is to prepare for an industrial accident in advance, which can be occurred in a poor working environment, by monitoring in real-time a body temperature displacement value, a heartbeat displacement value or a slope displacement value transmitted from an RF communication module existing inside or outside a workplace and creating a warning signal to make a warning sound or to make an LED emit light if the body temperature displacement value, the heartbeat displacement value or the slope displacement value is larger than a reference body temperature displacement value, a reference heartbeat displacement value or a reference slope displacement value.

In addition, a second object of the present invention is to periodically receive a body temperature displacement value, a heartbeat displacement value or a slope displacement value transmitted through a wired or wireless communication network and thoroughly investigate safety management status of a field where an RF communication module is located so as to improve working environments and protect lives of workers in the field by checking health states of the workers working in the field in real-time and promptly taking emergency measurements for an emergency situation which may occur while working.

In addition, a third object of the present invention is to warn workers in the neighborhood about a dangerous situation in the field and prevent spread of additional human damage by immediately recognizing various risk factors of the accidents occurring in a large construction field or a dangerous working field and promptly propagating corresponding risk factors to workers in the same space.

In addition, a fourth object of the present invention is to immediately transfer dangerous conditions of adjacent structures to a manager operating a general server and induce immediate and active measurements corresponding to an emergency situation so as to improve environments of workers and contribute to development of industry according thereto by reducing risk factors and damage of human lives.

To accomplish the above objects, the present invention includes the configuration described below.

That is, a real-time alarm system for field safety management according to an embodiment of the present invention includes: an RF communication module for outputting a warning sound by first-switching a current off state of a buzzer to an on state or making an LED emit light by second-switching a current off state of the LED to an on state, as a warning signal is received through an RF transmit and receive unit; a field management communication terminal for monitoring in real-time a body temperature displacement value, a heartbeat displacement value or a slope displacement value transmitted from the RF communication module and creating the warning signal if the body temperature displacement value, the heartbeat displacement value or the slope displacement value is larger than a reference body temperature displacement value, a reference heartbeat displacement value or a reference slope displacement value set in advance; and a general server for periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located.

In addition, a method of driving a real-time alarm system for field safety management according to an embodiment of the present invention includes the steps of: monitoring in real-time a body temperature displacement value, a heartbeat displacement value or a slope displacement value transmitted from an RF communication module and creating a warning signal if the body temperature displacement value, the heartbeat displacement value or the slope displacement value is larger than a reference body temperature displacement value, a reference heartbeat displacement value or a reference slope displacement value set in advance, by a field management communication terminal; outputting a warning sound by first-switching a current off state of a buzzer to an on state or making an LED emit light by second-switching a current off state of the LED to an on state, as the warning signal is received through an RF transmit and receive unit, by the RF communication module; and periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located, by a general server.

DETAILED DESCRIPTION OF THE PREFERRED EMBODIMENT

Embodiment

An embodiment of the present invention will be hereafter described in detail, with reference to the accompanying drawings.

Figure 1:
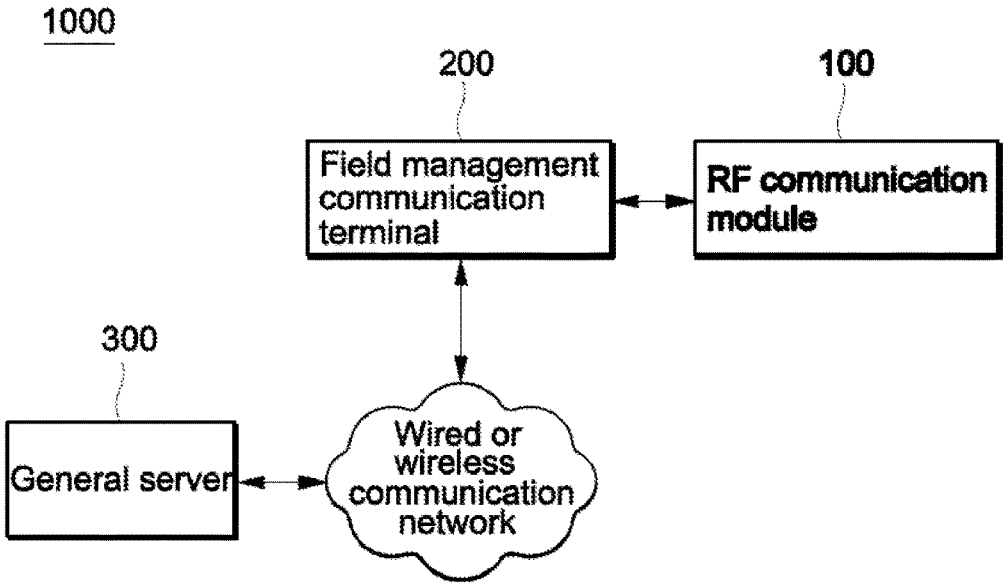
FIG. 1 is a view showing a real-time alarm system for field safety management according to an embodiment of the present invention.

FIG. 1 is a view showing a real-time alarm system for field safety management according to an embodiment of the present invention.

Referring to FIG. 1, a real-time alarm system for field safety management 1000 is a system which monitors in real-time a body temperature displacement value, a heartbeat displacement value or a slope displacement value transmitted from an RF communication module 100 existing inside or outside a workplace, creates a warning signal to make a warning sound or to make an LED emit light if the body temperature displacement value, the heartbeat displacement value or the slope displacement value is larger than a reference body temperature displacement value, a reference heartbeat displacement value or a reference slope displacement value, periodically receives the body temperature displacement value, the heartbeat displacement value or the slope displacement value transmitted through a wired or wireless communication network, and thoroughly investigates safety management status of the field where the RF communication module 100 is installed, and the system includes the RF communication module 100, a field management communication terminal 200 and a general server 300.

Figure 2:
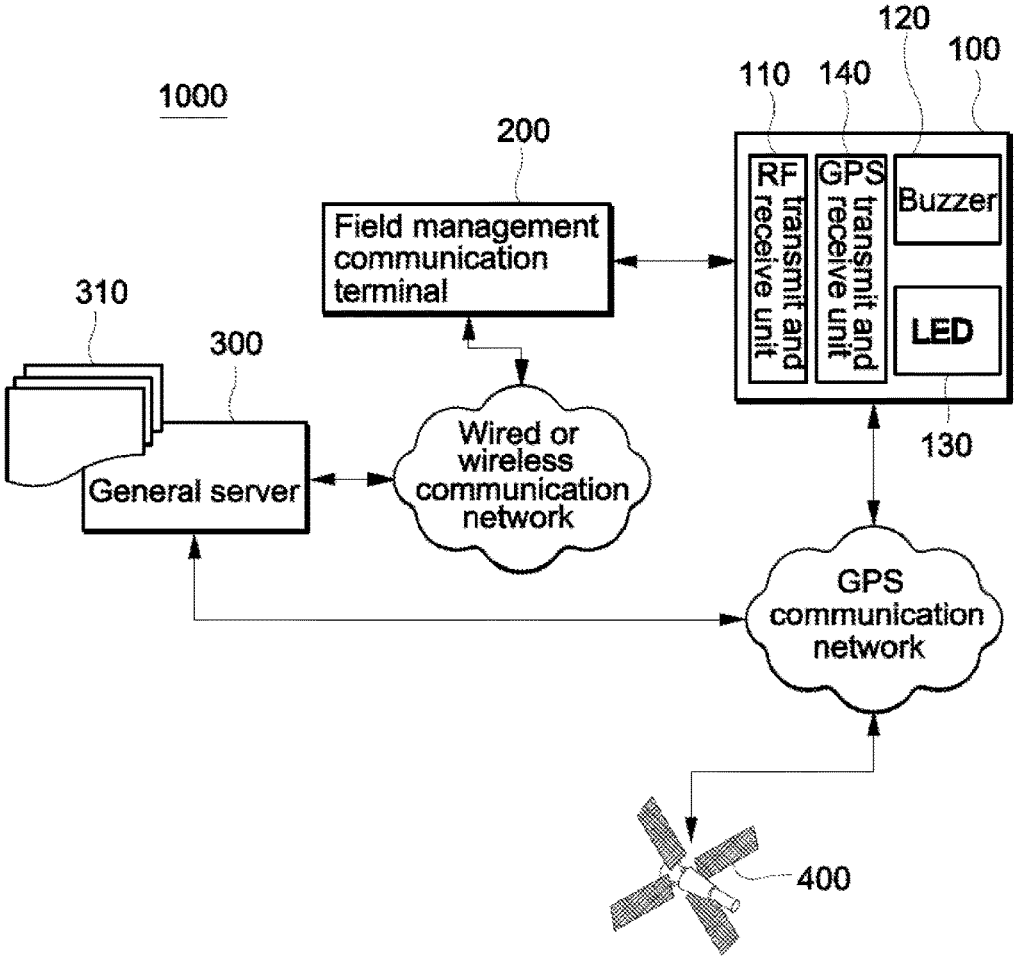
FIG. 2 is a detailed view further specifically showing a real-time alarm system for field safety management according to an embodiment of the present invention.

First, as the warning signal is received through an RF transmit and receive unit 110 as shown in FIG. 2, the RF communication module 100 outputs a warning sound by first-switching the current off state of a previously provided buzzer 120 to an on state or makes a previously provided LED 130 emit light by second-switching the current off state of the LED 130 to an on state.

The RF communication module 100 extracts a warning guidance message recorded in warning guidance information and displays outside the warning guidance message using the LED.

When the buzzer 120 is switched to a mute mode by changing the on state to the off state, the RF communication module 100 displays outside any one selected among a red light, a green light and a blue light emitted from the LED 130, instead of the warning sound.

The RF communication module 100 separately prepares a sticker type combining member on one side to be attached to a safety helmet or working clothes, and the outer surface of the sticker type combining member is coated with polyester-based synthetic resin to block absorption of sweat.

Figure 3:
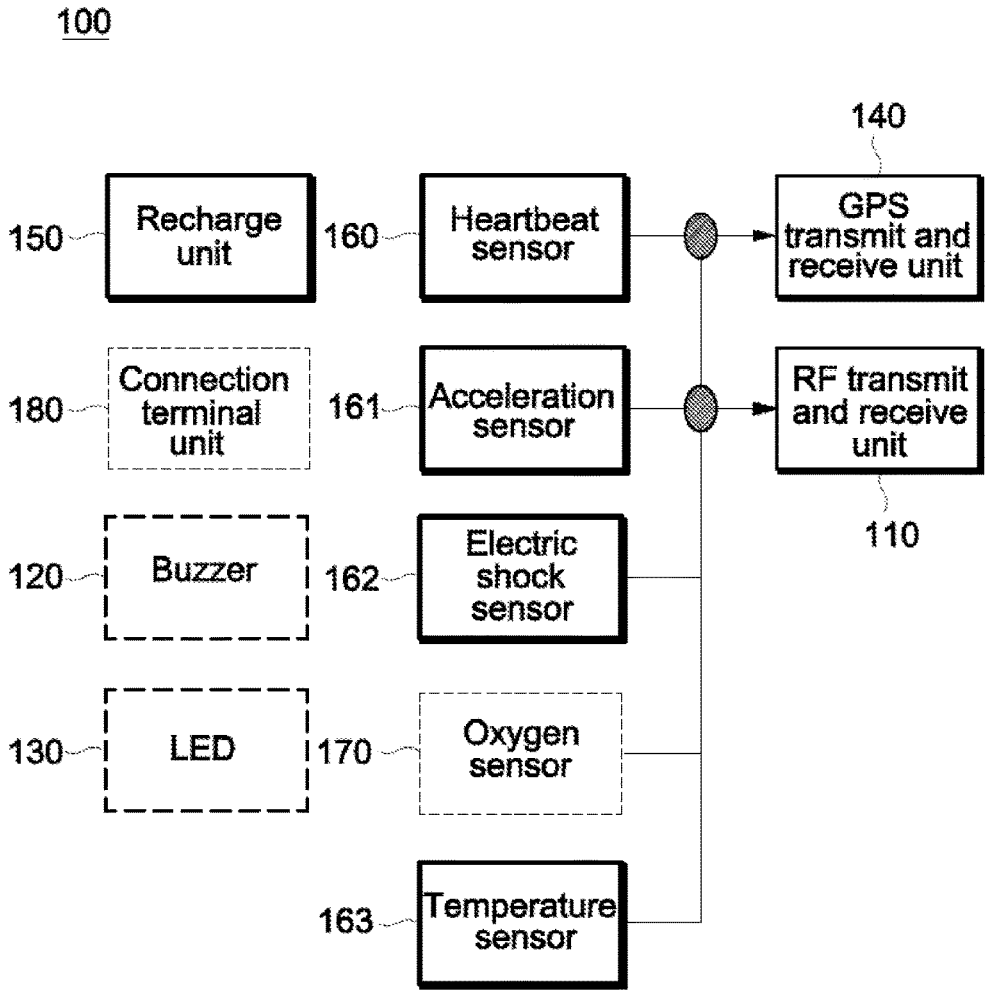
FIG. 3 is a detailed view showing an RF communication module of a real-time alarm system for field safety management according to an embodiment of the present invention.
Figure 4:
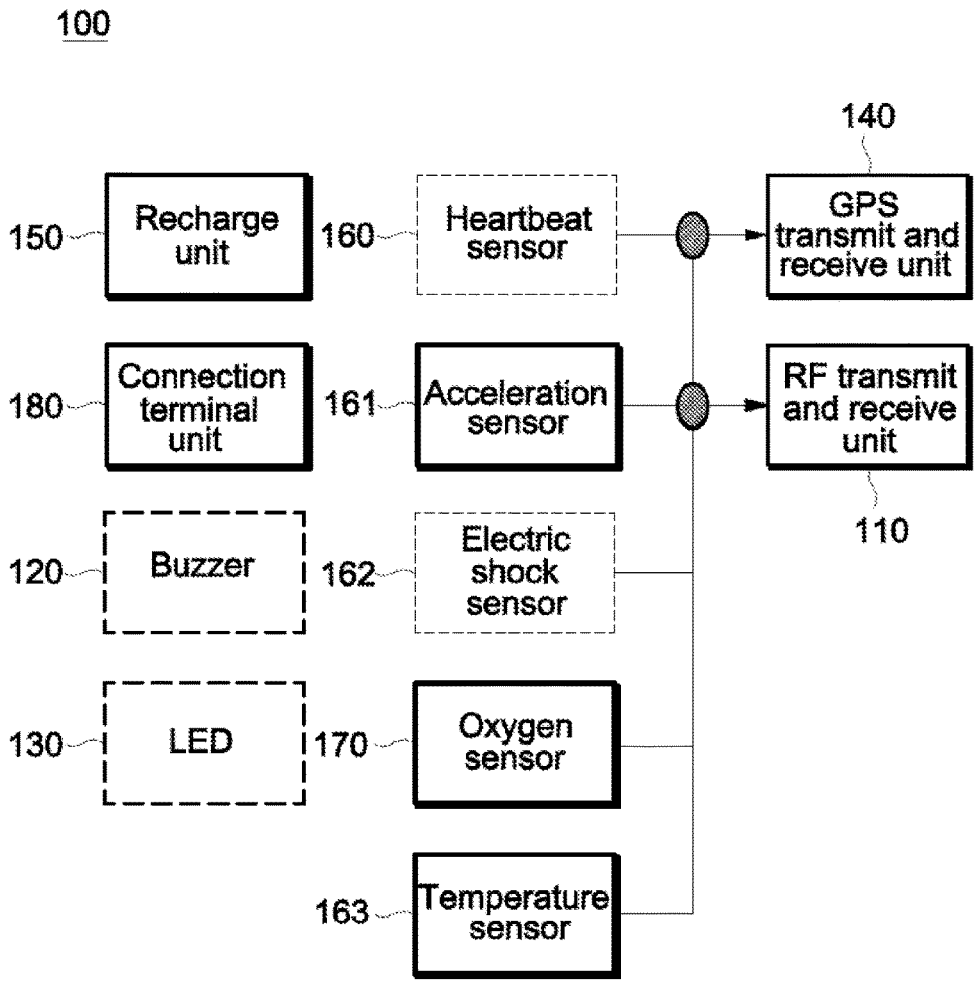
FIG. 4 is another detailed view showing an RF communication module of a real-time alarm system for field safety management according to an embodiment of the present invention.

In addition, the RF communication module 100 generally refers to a human body attachable type module and a landmark installation type module as is understood through FIGS. 3 and 4, and a human body attachable type RF communication module 100 is provided with a recharge unit 150 on which primary and secondary batteries are mounted, and it can be a communication module manufactured to be able to install at least one of a heartbeat sensor 160, an acceleration sensor 161, a temperature sensor 163, an electric shock sensor 162, a GPS transmit and receive unit 140 and an RF transmit and receive unit 110.

For example, when the RF communication module 100 is attached to a safety helmet or working clothes, i.e., when the human body attachable type module is used as the RF communication module 100, the acceleration sensor 161 previously provided in the RF communication module 100 measures a slope displacement value filtered through a previously provided low-pass filter after recognizing a state of taking off the safety helmet or the working clothes, an external shock state and a movement state.

The heartbeat sensor 160 measures a heartbeat displacement value filtered through the low-pass filter after sensing a heartbeat state of a user possessing the RF communication module 100.

In addition, the temperature sensor 163 measures a body temperature displacement value filtered through the low-pass filter after sensing a body temperature state of the user, and the electric shock sensor 162 senses whether or not the user gets an electric shock.

A landmark installation type RF communication module 100 is provided with a recharge unit 150 on which primary and secondary batteries are mounted, and it can be a communication module manufactured to be able to install at least one of an oxygen sensor 170, an acceleration sensor 161, a temperature sensor 163, a GPS transmit and receive unit 140, an RF transmit and receive unit 110 and a connection terminal unit 180.

For another example, when the RF communication module 100 is installed in a landmark, i.e., when the landmark installation type module is used as the RF communication module 100, the acceleration sensor 161 previously provided in the RF communication module 100 measures a slope displacement value filtered through a previously provided low-pass filter after sensing a rock slide state, a gravity acceleration state and a vibration state of the landmark.

The temperature sensor 163 measures a temperature displacement value filtered through the low-pass filter after sensing a temperature state around the landmark, and the oxygen sensor 170 senses and measures a displacement value of the amount of toxic gas generated or being generated around the landmark or a displacement value of the current amount of oxygen.

Successively, the RF communication module 100 stores workplace location information remotely transmitted to the RF transmit and receive unit 110 by way of a local area network previously connected to the field management communication terminal 200 described below or workplace location information remotely transmitted to the GPS transmit and receive unit 140 by way of a GPS communication network previously connected to the general server 300 described below (i.e., a satellite communication network constructed to operate a GPS system including a satellite 400).

In addition, the RF communication module 100 checks a workplace confirmed from the workplace location information and information on flow of users and heavy equipment existing in the workplace in real-time and transmits the information to the local area network or the GPS communication network.

The RF communication module 100 stores landmark location information remotely transmitted to the RF transmit and receive unit 110 by way of a local area network previously connected to the field management communication terminal 200 or landmark location information remotely transmitted to the GPS transmit and receive unit 140 by way of a GPS communication network previously connected to the general server 300.

In addition, the RF communication module 100 checks landmark displacement information confirmed from the landmark location information in real-time and transmits the information to the local area network or the GPS communication network.

The field management communication terminal 200 monitors in real-time a body temperature displacement value, a heartbeat displacement value or a slope displacement value transmitted from the RF communication module 100 and creates a warning signal if the body temperature displacement value, the heartbeat displacement value or the slope displacement value is larger than a reference body temperature displacement value, a reference heartbeat displacement value or a reference slope displacement value set in advance.

The field management communication terminal 200 loads warning guidance information on the warning signal and directly transmits the warning guidance information to the RF communication module 100.

The general server 100 periodically receives the body temperature displacement value, the heartbeat displacement value or the slope displacement value at the intervals of a day, a week, a month or a year through a wired or wireless communication network previously connected to the field management communication terminal 200, derives a plurality of quantitative graphs related to safety management status of the field where the RF communication module 100 is installed, and manages and controls a reporting work 310 related to the safety management status of the field according thereto.

Figure 5:
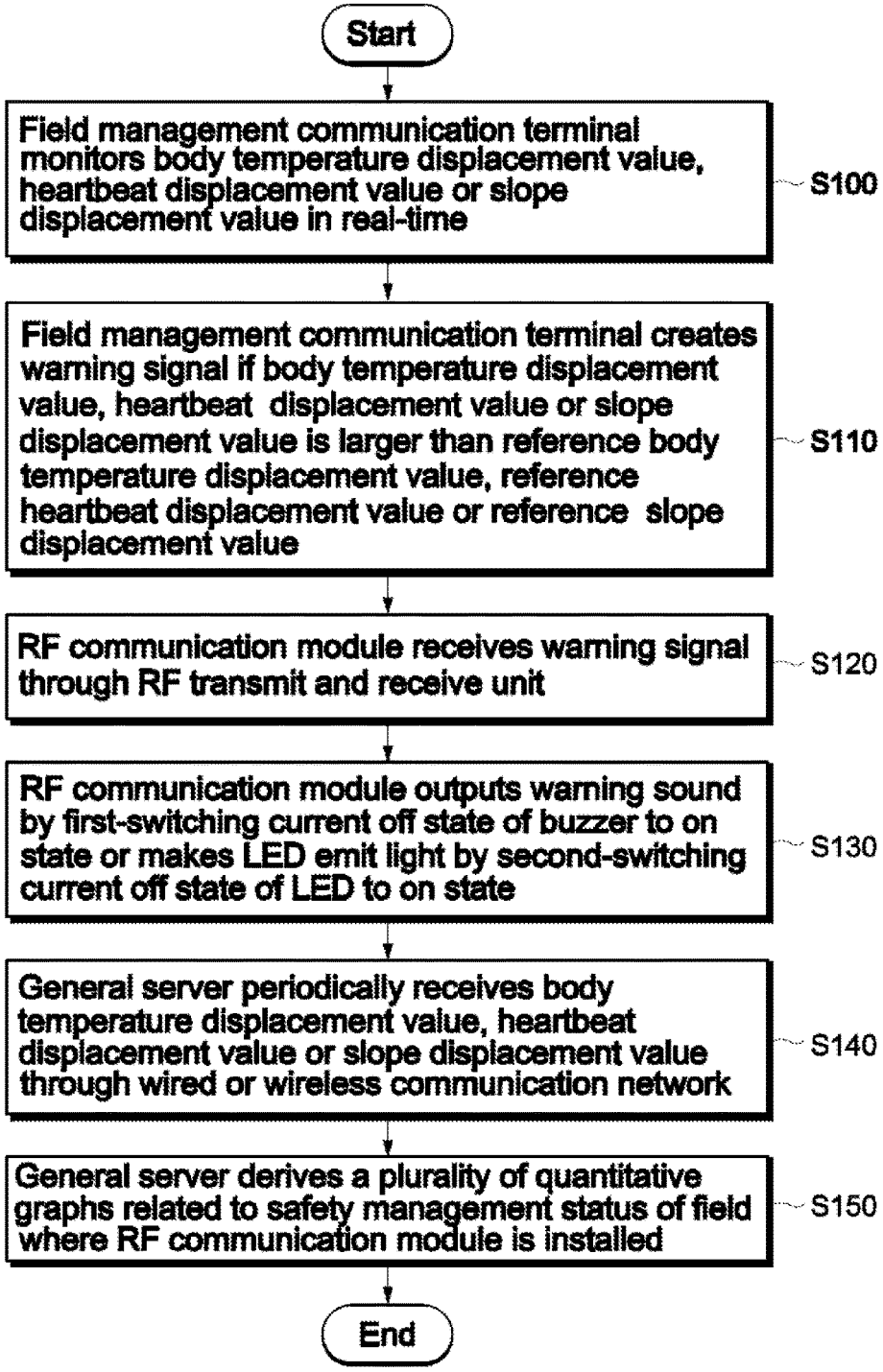
FIG. 5 is a flowchart illustrating a method of driving a real-time alarm system for field safety management according to an embodiment of the present invention.

FIG. 5 is a flowchart illustrating a method of driving a real-time alarm system for field safety management according to an embodiment of the present invention.

Referring to FIG. 5, the method of driving a real-time alarm system for field safety management is a driving method which monitors in real-time a body temperature displacement value, a heartbeat displacement value or a slope displacement value transmitted from an RF communication module existing inside or outside a workplace, creates a warning signal to make a warning sound or to make an LED emit light if the body temperature displacement value, the heartbeat displacement value or the slope displacement value is larger than a reference body temperature displacement value, a reference heartbeat displacement value or a reference slope displacement value, periodically receives the body temperature displacement value, the heartbeat displacement value or the slope displacement value transmitted through a wired or wireless communication network, and thoroughly investigates safety management status of the field where the RF communication module is located.

The field management communication terminal monitors in real-time a body temperature displacement value, a heartbeat displacement value or a slope displacement value transmitted from the RF communication module (step S100) and creates a warning signal if the body temperature displacement value, the heartbeat displacement value or the slope displacement value is larger than the reference body temperature displacement value, the reference heartbeat displacement value or the reference slope displacement value set in advance (step S110).

As the warning signal is received through the RF transmit and receive unit, the RF communication module outputs a warning sound by first-switching the current off state of a buzzer to an on state or makes an LED emit light by second-switching the current off state of the LED to an on state (steps S120 and S130).

The general server periodically receives the body temperature displacement value, the heartbeat displacement value or the slope displacement value at the intervals of a day, a week, a month or a year through a wired or wireless communication network previously connected to the field management communication terminal and derives a plurality of quantitative graphs related to safety management status of the field where the RF communication module is located (steps S140 and S150).

As an additional explanation, the RF communication module stores workplace location information remotely transmitted to the RF transmit and receive unit by way of a local area network previously connected to the field management communication terminal or workplace location information remotely transmitted to the GPS transmit and receive unit by way of a GPS communication network previously connected to the general server.

The RF communication module stores landmark location information remotely transmitted to the RF transmit and receive unit by way of a local area network previously connected to the field management communication terminal or landmark location information remotely transmitted to the GPS transmit and receive unit by way of a GPS communication network previously connected to the general server.

In addition, the RF communication module checks a workplace confirmed from the workplace location information and information on flow of users and heavy equipment existing in the workplace in real-time and transmits the information to the local area network or the GPS communication network, and the RF communication module checks landmark displacement information confirmed from the landmark location information in real-time and transmits the information to the local area network or the GPS communication network.

Further additional operations related to the method of driving a real-time alarm system for field safety management according to an embodiment of the present invention can be embodied easily as described below.

The field management communication terminal loads warning guidance information on a warning signal and directly transmits the warning guidance information to the RF communication module, and the RF communication module extracts a warning guidance message recorded in the warning guidance information and displays outside the warning guidance message using the LED.

When the buzzer is switched to a mute mode by changing the on state to the off state, the RF communication module displays outside any one selected among a red light, a green light and a blue light emitted from the LED, instead of the warning sound.

A human body attachable type module, which is one selected among the RF communication modules, is provided with a recharge unit on which primary and secondary batteries are mounted, and it installs at least one of a heartbeat sensor, an acceleration sensor, a temperature sensor, an electric shock sensor, a GPS transmit and receive unit and an RF transmit and receive unit.

That is, for example, when an RF communication module of a human body attachable type is attached to a safety helmet or working clothes, the acceleration sensor previously provided in the human body attachable type RF communication module measures a slope displacement value filtered through a previously provided low-pass filter after sensing a state of taking off the safety helmet or the working clothes, an external shock state and a movement state.

The heartbeat sensor measures a heartbeat displacement value filtered through the low-pass filter after sensing a heartbeat state of a user possessing the RF communication module.

The temperature sensor measures a body temperature displacement value filtered through the low-pass filter after sensing a body temperature state of the user, and the electric shock sensor senses whether or not the user gets an electric shock.

A landmark installation type module, which is another one selected among the RF communication modules, is provided with a recharge unit on which primary and secondary batteries are mounted, and it installs at least one of an oxygen sensor, an acceleration sensor, a temperature sensor, a GPS transmit and receive unit, an RF transmit and receive unit and a connection terminal unit.

That is, for another example, when an RF communication module of a landmark installation type is installed in a landmark, the acceleration sensor measures a slope displacement value filtered through a previously provided low-pass filter after sensing a rock slide state, a gravity acceleration state and a vibration state of the landmark.

The temperature sensor measures a temperature displacement value filtered through the low-pass filter after sensing a temperature state around a landmark, and the oxygen sensor senses and measures an amount of toxic gas generated or being generated around the landmark or a current amount of oxygen.

The method of driving the real-time alarm system for field safety management of the present invention has been made to solve the problems of the conventional technology, and a first object of the present invention is to prepare for an industrial accident in advance, which can be occurred in a poor working environment, by monitoring in real-time a body temperature displacement value, a heartbeat displacement value or a slope displacement value transmitted from an RF communication module existing inside or outside a workplace and creating a warning signal to make a warning sound or make LED emit light if the body temperature displacement value, the heartbeat displacement value or the slope displacement value is larger than a reference body temperature displacement value, a reference heartbeat displacement value or a reference slope displacement value.

In addition, a second object of the present invention is to periodically receive a body temperature displacement value, a heartbeat displacement value or a slope displacement value transmitted through a wired or wireless communication network and thoroughly investigate safety management status of a field where an RF communication module is located so as to improve working environments and protect lives of workers in the field by checking health states of the workers working in the field in real-time and promptly taking emergency measurements for an emergency situation which may occur while working.

In addition, a third object of the present invention is to warn workers in the neighborhood about a dangerous situation in the field and prevent spread of additional human damage by immediately recognizing various risk factors of the accidents occurring in a large construction field or a dangerous working field and promptly propagating corresponding risk factors to workers in the same space.

In addition, a fourth object of the present invention is to immediately transfer dangerous conditions of adjacent structures to a manager operating a general server and induce immediate and active measurements corresponding to an emergency situation so as to improve environments of workers and contribute to development of industry according thereto by reducing risk factors and damage of human lives.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A real-time alarm system for field safety management, the system comprising:

an RF communication module for outputting a warning sound by first-switching a current off state of a buzzer to an on state or making an LED emit light by second-switching a current off state of the LED to an on state, as a warning signal is received through an RF transmit and receive unit;

a field management communication terminal for monitoring in real-time a body temperature displacement value, a heartbeat displacement value or a slope displacement value transmitted from the RF communication module and creating the warning signal if the body temperature displacement value, the heartbeat displacement value or the slope displacement value is larger than a reference body temperature displacement value, a reference heartbeat displacement value or a reference slope displacement value set in advance; and a general server for periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located, wherein as the field management communication terminal loads warning guidance information on the warning signal and directly transmits the warning guidance information to the RF communication module, the RF communication module extracts a warning guidance message recorded in the warning guidance information and displays outside the warning guidance message using the LED.

2. The system according to claim 1, wherein when the buzzer is switched to a mute mode by changing the on state to the off state, the RF communication module displays outside any one selected among a red light, a green light and a blue light emitted from the LED, instead of the warning sound.

3. The system according to claim 1, wherein the RF communication module separately prepares a sticker type combining member on one side to be attached to a safety helmet or working clothes, and an outer surface of the sticker type combining member is coated with polyester-based synthetic resin to block absorption of sweat.

4. A real-time alarm system for field safety management, the system comprising:

an RF communication module for outputting a warning sound by first-switching a current off state of a buzzer to an on state or making an LED emit light by second-switching a current off state of the LED to an on state, as a warning signal is received through an RF transmit and receive unit;

a field management communication terminal for monitoring in real-time a body temperature displacement value, a heartbeat displacement value or a slope displacement value transmitted from the RF communication module and creating the warning signal if the body temperature displacement value, the heartbeat displacement value or the slope displacement value is larger than a reference body temperature displacement value, a reference heartbeat displacement value or a reference slope displacement value set in advance; and a general server for periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located, wherein the RF communication module is any one selected among a human body attachable type module provided with a recharge unit on which primary and secondary batteries are mounted and installing at least one of a heartbeat sensor, an acceleration sensor, a temperature sensor, an electric shock sensor, a GPS transmit and receive unit and an RF transmit and receive unit, and a landmark installation type module provided with a recharge unit on which primary and secondary batteries are mounted and installing at least one of an oxygen sensor, an acceleration sensor, a temperature sensor, a GPS transmit and receive unit, an RF transmit and receive unit and a connection terminal unit.

5. The system according to claim 4, wherein when the RF communication module is attached to a safety helmet or working clothes, the acceleration sensor measures the slope displacement value filtered through a previously provided low-pass filter after sensing a state of taking off the safety helmet or the working clothes, an external shock state and a movement state, the heartbeat sensor measures the heartbeat displacement value filtered through the low-pass filter after sensing a heartbeat state of a user possessing the RF communication module, the temperature sensor measures the body temperature displacement value filtered through the low-pass filter after sensing a body temperature state of the user, and the electric shock sensor senses whether or not the user gets an electric shock.

6. The system according to claim 4, wherein when the RF communication module is installed in a landmark, the acceleration sensor measures the slope displacement value filtered through a previously provided low-pass filter after sensing a rock slide state, a gravity acceleration state and a vibration state of the landmark, the temperature sensor measures the temperature displacement value filtered through the low-pass filter after sensing a temperature state around the landmark, and the oxygen sensor senses and measures an amount of toxic gas generated or being generated around the landmark or a current amount of oxygen.

7. The system according to claim 4, wherein the RF communication module stores workplace location information remotely transmitted to the RF transmit and receive unit by way of a local area network previously connected to the field management communication terminal or workplace location information remotely transmitted to the GPS transmit and receive unit by way of a GPS communication network previously connected to the general server, checks a workplace confirmed from the workplace location information and information on flow of users and heavy equipment existing in the workplace in real-time, and transmits the information to the local area network or the GPS communication network.

8. The system according to claim 4, wherein the RF communication module stores landmark location information remotely transmitted to the RF transmit and receive unit by way of a local area network previously connected to the field management communication terminal or landmark location information remotely transmitted to the GPS transmit and receive unit by way of a GPS communication network previously connected to the general server, checks landmark displacement information confirmed from the landmark location information in real-time and transmits the information to the local area network or the GPS communication network.

9. A method of driving a real-time alarm system for field safety management, the method comprising the steps of:

monitoring in real-time a body temperature displacement value, a heartbeat displacement value or a slope displacement value transmitted from an RF communication module and creating a warning signal if the body temperature displacement value, the heartbeat displacement value or the slope displacement value is larger than a reference body temperature displacement value, a reference heartbeat displacement value or a reference slope displacement value set in advance, by a field management communication terminal;

outputting a warning sound by first-switching a current off state of a buzzer to an on state or making an LED emit light by second-switching a current off state of the LED to an on state, as the warning signal is received through an RF transmit and receive unit, by the RF communication module;

periodically receiving the body temperature displacement value, the heartbeat displacement value or the slope displacement value at intervals of a day, a week, a month or a year through a wired or wireless communication network previously connected to the field management communication terminal and deriving a plurality of quantitative graphs related to safety management status of a field where the RF communication module is located, by a general server;

loading warning guidance information on the warning signal and directly transmitting the warning guidance information to the RF communication module, by the field management communication terminal; and extracting a warning guidance message recorded in the warning guidance information and displaying outside the warning guidance message using the LED, by the RF communication module.

10. The method according to claim 9, further comprising the step of displaying outside any one selected among a red light, a green light and a blue light emitted from the LED, instead of the warning sound when the buzzer is switched to a mute mode by changing the on state to the off state, by the RF communication module.

11. The method according to claim 9, further comprising the step of:

providing a recharge unit on which primary and secondary batteries are mounted and installing at least one of a heartbeat sensor, an acceleration sensor, a temperature sensor, an electric shock sensor, a GPS transmit and receive unit and an RF transmit and receive unit, in a human body attachable type module, which is one selected among the RF communication modules, or providing a recharge unit on which primary and secondary batteries are mounted and installing at least one of an oxygen sensor, an acceleration sensor, a temperature sensor, a GPS transmit and receive unit, an RF transmit and receive unit and a connection terminal unit, in a landmark installation type module, which is another one selected among the RF communication modules.

12. The method according to claim 11, further comprising, when the RF communication module is attached to a safety helmet or working clothes, the steps of:

measuring the slope displacement value filtered through a previously provided low-pass filter after sensing a state of taking off the safety helmet or the working clothes, an external shock state and a movement state, by the acceleration sensor;

measuring the heartbeat displacement value filtered through the low-pass filter after sensing a heartbeat state of a user possessing the RF communication module, by the heartbeat sensor;

measuring the body temperature displacement value filtered through the low-pass filter after sensing a body temperature state of the user, by the temperature sensor; and sensing whether or not the user gets an electric shock, by the electric shock sensor.

13. The method according to claim 11, further comprising, when the RF communication module is installed in a landmark, the steps of:

measuring the slope displacement value filtered through a previously provided low-pass filter after sensing a rock slide state, a gravity acceleration state and a vibration state of the landmark, by the acceleration sensor;

measuring the temperature displacement value filtered through the low-pass filter after sensing a temperature state around the landmark, by the temperature sensor; and sensing and measuring an amount of toxic gas generated or being generated around the landmark or a current amount of oxygen, by the oxygen sensor.

14. The method according to claim 11, further comprising the steps of:

storing workplace location information remotely transmitted to the RF transmit and receive unit by way of a local area network previously connected to the field management communication terminal or workplace location information remotely transmitted to the GPS transmit and receive unit by way of a GPS communication network previously connected to the general server; and checking a workplace confirmed from the workplace location information and information on flow of users and heavy equipment existing in the workplace in real-time and transmitting the information to the local area network or the GPS communication network, by the RF communication module.

15. The method according to claim 11, further comprising the steps of:

storing landmark location information remotely transmitted to the RF transmit and receive unit by way of a local area network previously connected to the field management communication terminal or landmark location information remotely transmitted to the GPS transmit and receive unit by way of a GPS communication network previously connected to the general server; and checking landmark displacement information confirmed from the landmark location information in real-time and transmitting the information to the local area network or the GPS communication network, by the RF communication module.

* * * * *